US007621203B2

(12) United States Patent
Aviza

(10) Patent No.: US 7,621,203 B2
(45) Date of Patent: Nov. 24, 2009

(54) SHAVING RAZORS, AND BLADE SUBASSEMBLIES THEREFOR AND METHODS OF MANUFACTURE

(75) Inventor: Gregory D. Aviza, Marlborough, MA (US)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 10/774,780

(22) Filed: Feb. 9, 2004

(65) Prior Publication Data

US 2005/0172489 A1 Aug. 11, 2005

(51) Int. Cl.
*B26B 21/22* (2006.01)

(52) U.S. Cl. ..... 83/13; 30/50; 30/51

(58) Field of Classification Search ..... 30/50, 30/339, 338, 51
See application file for complete search history.

(56) References Cited

U.S. PATENT DOCUMENTS

| | | | | | |
|---|---|---|---|---|---|
| 3,660,893 | A * | 5/1972 | Welsh | 30/50 |
| 4,200,976 | A * | 5/1980 | Gooding | 30/47 |
| 4,302,876 | A * | 12/1981 | Emmett | 30/47 |
| 4,378,634 | A * | 4/1983 | Jacobson | 30/47 |
| 4,516,321 | A * | 5/1985 | Francis | 30/50 |
| 4,868,983 | A * | 9/1989 | Francis | 30/50 |
| 4,932,122 | A | 6/1990 | Shurland et al. | 30/50 |
| 5,003,694 | A * | 4/1991 | Chen | 30/49 |
| 5,253,420 | A | 10/1993 | Althaus et al. | |
| 5,282,316 | A * | 2/1994 | Anderson | 30/294 |
| 5,313,706 | A | 5/1994 | Motta et al. | 30/57 |
| 5,369,885 | A | 12/1994 | Ferraro | 30/41 |
| 5,416,974 | A | 5/1995 | Wain | 30/50 |
| 5,546,660 | A | 8/1996 | Burout et al. | 30/50 |
| 6,009,624 | A | 1/2000 | Apprille, Jr. et al. | 30/50 |
| 6,032,372 | A | 3/2000 | Dischler | 30/346.57 |
| 6,145,201 | A | 11/2000 | Andrews | 30/50 |
| 6,161,288 | A | 12/2000 | Andrews | 30/50 |
| 6,216,345 | B1 | 4/2001 | Andrews | 30/50 |
| 6,216,561 | B1 | 4/2001 | Dischler | 76/104.1 |
| 6,397,473 | B1 | 6/2002 | Clark | 30/50 |
| 6,671,961 | B1 * | 1/2004 | Santhagens Van Eibergen et al. | 30/50 |
| 2002/0157259 | A1 | 10/2002 | Coffin | |
| 2003/0159291 | A1 | 8/2003 | Clark | |
| 2003/0208907 | A1 * | 11/2003 | Brown et al. | 30/50 |
| 2004/0128835 | A1 * | 7/2004 | Coffin et al. | 30/50 |

FOREIGN PATENT DOCUMENTS

| | | |
|---|---|---|
| EP | 0 293 683 | 12/1988 |
| WO | WO 96/29183 | 9/1996 |

* cited by examiner

*Primary Examiner*—Kenneth E. Peterson
(74) *Attorney, Agent, or Firm*—Joanne N. Pappas; Kevin C. Johnson; Steven W. Miller

(57) ABSTRACT

A subassembly for a shaving razor including a plurality of elongated metal blades. The blades having cutting edges defining a shaving surface longitudinal ends and are secured at their longitudinal ends to first and second plastic blocks to provide an integral unit.

5 Claims, 8 Drawing Sheets

SHAVING RAZORS, AND BLADE SUBASSEMBLIES THEREFOR AND METHODS OF MANUFACTURE

The invention relates to shaving razors, and blade subassemblies therefor and methods of manufacture.

Shaving razors often include a plurality of blades that are secured in a desired position in a plastic housing. The housing is often provided with a guard with fins or other skin engaging structures made of elastomeric material in front of the blades, and a cap on which the skin can slide behind the blades. A shaving aid (e.g., a lubricant agent dispensing mechanism) can be incorporated into the cap and, in some cases, the guard. The blades can be stationary or movable, and the housing can be fixed to a handle or movably mounted on the handle, to, e.g., assist in following the contours of the skin during shaving.

Examples of some different types of shaving razors are described in U.S. Pat. Nos. 5,313,706; 5,369,885; 5,416,974; 5,546,660; 6,032,372; 6,145,201; 6,161,288; 6,216,345; 6,216,561; and 6,397,473.

SUMMARY OF THE INVENTION

In one aspect, the invention features, in general, a subassembly for a shaving razor including a plurality of elongated metal blades. The blades having cutting edges defining a shaving surface longitudinal ends and are secured at their longitudinal ends to first and second plastic blocks to provide an integral unit.

Particular embodiments of the invention may include one or more of the following features. In particular embodiments the longitudinal ends of the blades are received in slots in the first and second plastic blocks. The longitudinal ends of the blades and the slots have mating locking structure to secure the longitudinal ends to the first and second plastic blocks. The locking structure includes projections projecting into the slots that engage holes through the longitudinal ends. The longitudinal ends have a thickness that is greater than the width of the slot minus the height of the projection.

In some embodiments each blade includes an elongated cutting member having a cutting edge and an elongated support to which the elongated cutting member is attached, with the longitudinal ends of the elongated support being welded to each other at the two sides. In some other embodiments, each blade includes an elongated cutting member portion having a cutting edge and an integral elongated support portion bent downward from the cutting member portion, with the longitudinal ends of the elongated support portion being welded to each other at the two sides. In still other embodiments, each blade includes an elongated cutting member having a cutting edge, and the longitudinal ends extend from the elongated cutting member. The subassembly can have two blades, three blades, four blades or five blades or more. The cutting edges can be located in a common plane. The subassembly can have a snap-fitting structure for connection to a housing of a shaving razor.

In another aspect the invention features, in general, a shaving razor including a subassembly as already described, and a housing having a recess in which the subassembly is secured. The razor can have a stop member secured to the housing with the cutting edges resting against the stop member. The razor can have a biasing member secured to the housing and biasing the blades so that the cutting edges are biased against the stop member. The blades can be movable in the slots during shaving. The stop member is provided on the plastic block. Different slots can have stop members at different heights. The slots can be parallel or nonparallel.

In another aspect the invention features, in general, a method of making a shaving razor that includes providing a plurality of elongated metal razor blades having cutting edges and first and second longitudinal ends, and securing the first longitudinal ends to a first plastic block and the second longitudinal ends to a second end block at locations on the first and second plastic block such that the cutting edges define a shaving surface, and the blades and blocks provide an integrated blade subassembly.

Particular embodiments of the invention may include one or more of the following features. In particular embodiments the integrated subassembly is inserted into a recess in a housing of a shaving razor. The cutting edges are moved to contact a stop member on the housing. A biasing member secured to the housing to bias the cutting edges against the stop member. The integrated blade subassembly unit is held in the housing by a snap-fit connection. The recess can be open to the top, with the integral blade subassembly being lowered into the recess, or the recess can open to the bottom, with the integral blade subassembly being raised into the recess.

Embodiments of the invention may include one or more of the following advantages. Automated assembly of razor blade cartridges can be simplified by installing all of the blades as a unit in a single step. The geometry of the cutting edges with respect to each other can be set prior to assembly into a housing and tightly controlled and varied, if desired. The subassembly of blades can be removably mounted in a housing and replaced with a new subassembly as the blades become spent, thereby decreasing the parts that are disposed and reusing more parts. Also, integrated blade subassemblies can be manufactured with a variety of different blade geometries, with, e.g., different blade tangent angles, exposures, and/or spans, and the different subassemblies can all be used with a common design for the rest of the cartridge into which they are inserted, simplifying part count and tooling at the same time that a variety of different geometries can be easily implemented.

Other advantages and features of the invention will be apparent from the following description of particular embodiments thereof and from the claims.

BRIEF DESCRIPTION OF THE DRAWIMGS

DETAILED DESCRIPTION

Figure 1:
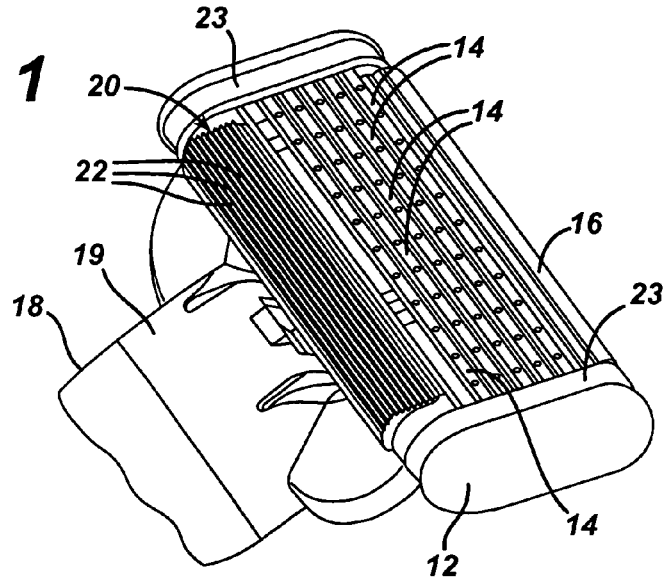
FIG. 1 is a partial, perspective view of a shaving razor.
Figure 7:
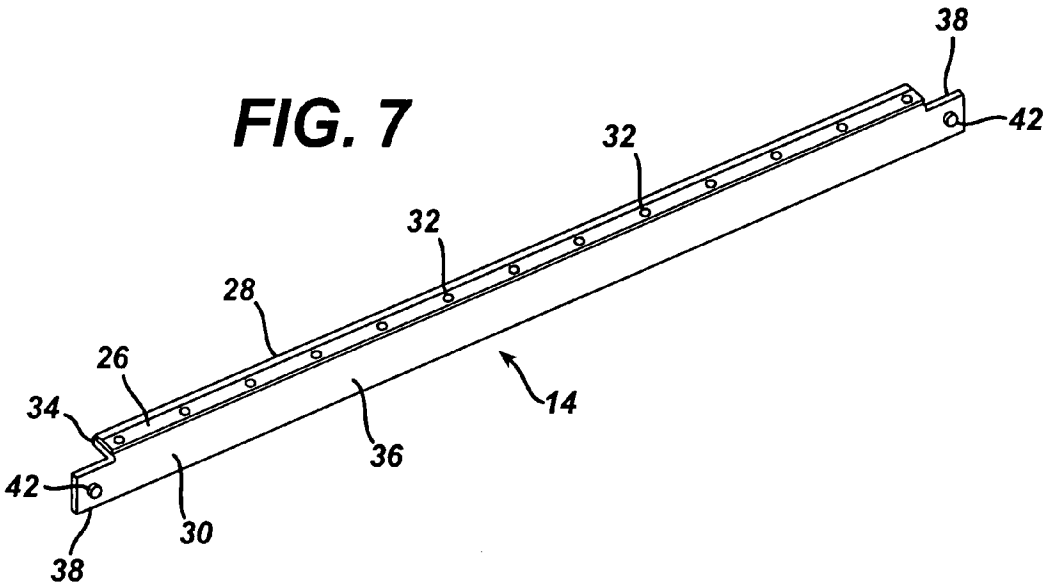
FIG. 7 is a perspective view of a blade of the FIG. 3 blade subassembly.
Figure 8:
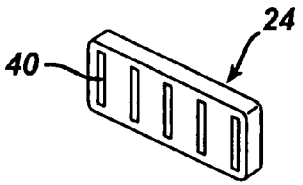
FIG. 8 is a perspective view of a plastic end block component of the FIG. 3 blade subassembly.

Referring to FIG. 1, shaving razor 10 includes plastic housing 12, blades 14 secured in housing 12, cap 16 (including a lubricating strip), handle 18, connecting piece 19 (which is pivotally connected to housing 12 and removably connected to handle 18), and elastomeric guard 20 which has fins 22. There are five blades 14 having cutting edges 28 (see FIG. 7) that define a shaving surface.

Figure 2:
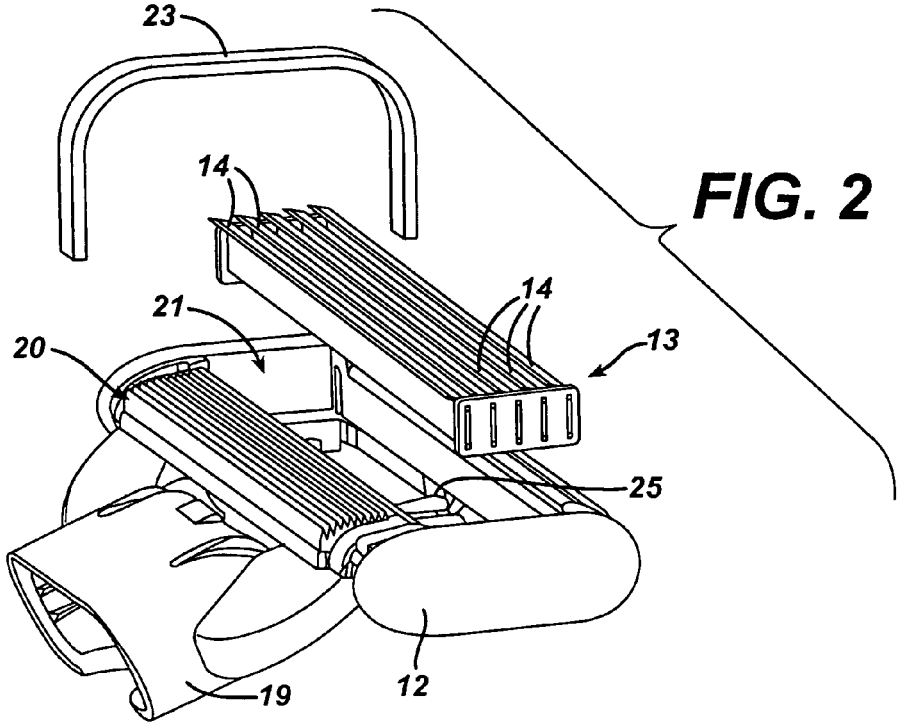
FIG. 2 is an exploded, partial, perspective view of the FIG. 1 shaving razor.
Figure 3:
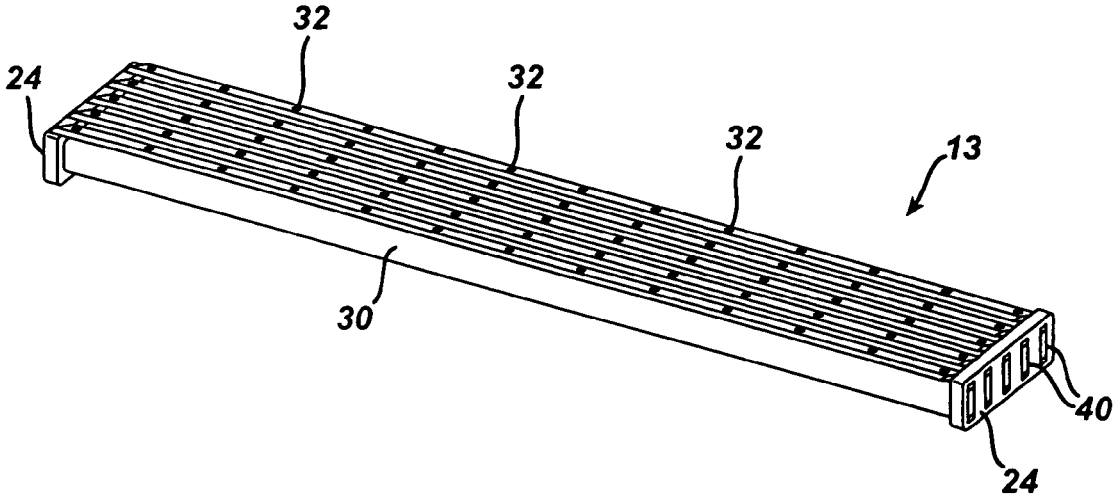
FIG. 3 is a perspective view of a blade subassembly of the FIG. 1 shaving razor.
Figure 6:
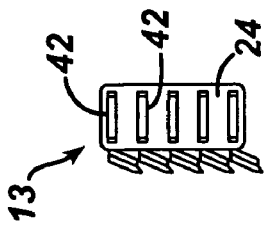
FIG. 6 is a side elevation of the FIG. 3 blade subassembly.
Figure 4:
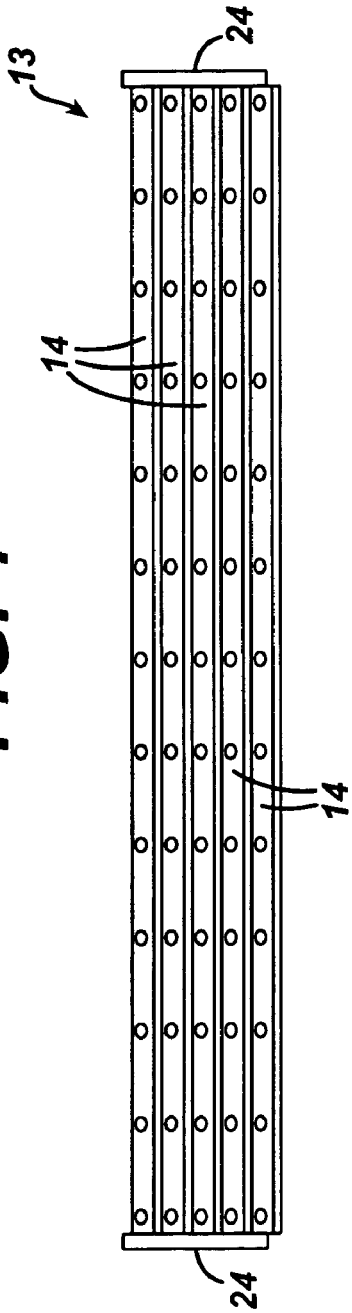
FIG. 4 is a plan view of the FIG. 3 blade subassembly.
Figure 5:
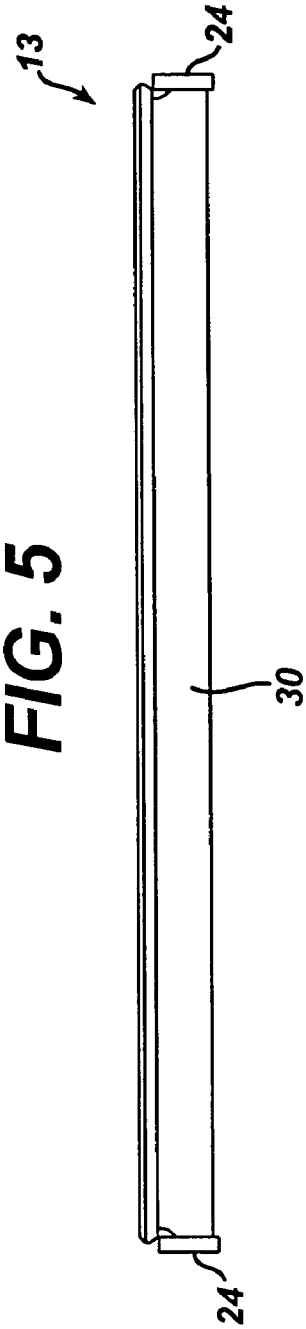
FIG. 5 is a front elevation of the FIG. 3 blade subassembly.

As appears from FIG. 2, blades 14 are provided in an integrated blade subassembly 13 that mounts in recess 21 in housing 12 from the top and is held in place by two clips 23, only one of which is shown in FIG. 2. Clips 23 define a stop surface against which the cutting edges rest at their edges. Elastomeric rail 25 attaches to the bottom of the housing across the width of the subassembly 13, biasing the bottoms of blades 14 upward. Other embodiments could have the blades inserted from the rear of the cartridge.

Referring to FIGS. 3-9, blade subassembly 13 includes five blades 14 and two side plastic end blocks 24.

Each blade 14 includes an elongated cutting member 26 having cutting edge 28 and elongated support 30 to which cutting member 26 is attached by spot welds 32. Elongated support has an angled section along its length, with a short upper portion 34 and longer base portion 36. The longitudinal ends 38 of base portion 36 are received in slots 40 in plastic end blocks 24. Each longitudinal end has a hole 42.

Figure 13:
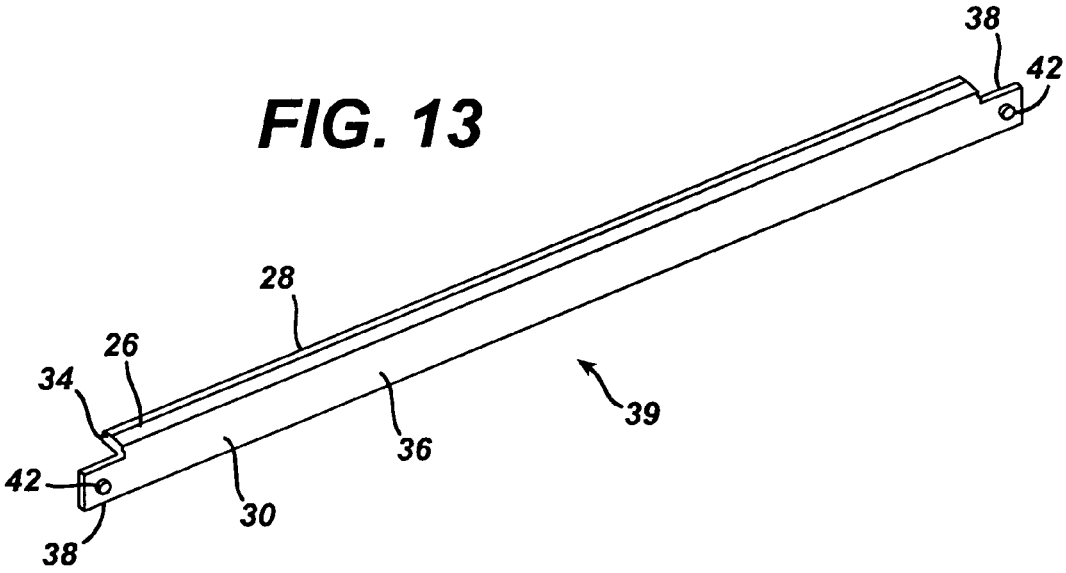
FIGS. 13-14 are perspective views of alternative, one-piece blade constructions.
Figure 14:
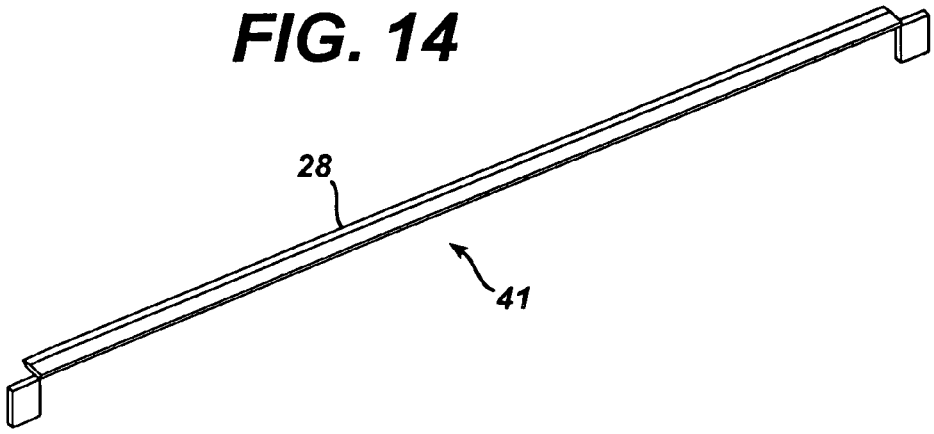

Alternatively, the elongated cutting members could be one-piece constructions having a cutting edge portion and an integral bent base portion, as shown, e.g., for one-piece complex member 39 in FIG. 13, or not even have a bent base portion, as shown, e.g., for one-piece simple cutting member 41 in FIG. 14.

Figure 9:
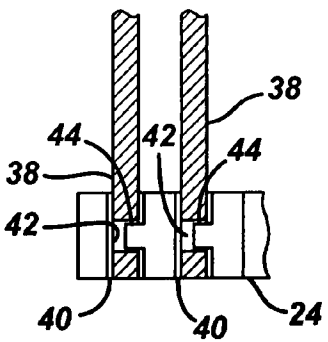
FIG. 9 is a sectional view showing the connection of the longitudinal ends of blades to plastic end blocks in the FIG. 3 blade subassembly.

Referring to FIG. 9, each slot 40 has a projection 44 that is received in a hole 42 to secure the longitudinal end 38 of a blade in an end block 24. Slots 40 have a width of 0.007"; longitudinal end 38 has a thickness of 0.006"; and projection 44 has a height of 0.015". The projections 44 deform slightly during insertion of a longitudinal end 38 into a slot 40, and then snap into hole 42 to secure the longitudinal end 38 of a blade 14 in the slot 40. After insertion of all longitudinal ends 38 in slots 40, the resulting integral blade subassembly 13 can then be simply inserted into recess 21 on top of elastomeric rail 25 and held in place in housing 12 by clips 23. The blades 14 are, to a limited extent, free floating in subassembly 13 prior to connection to housing 12. In housing 12, cutting edges 28 rest against stop surfaces provided by clips 23 on housing 12, and the bottoms of base portions 36 are biased upward by elastomer rail 25 at the bottom of housing 12. This sets the positions of the cutting edges defining a shaving surface.

Figure 10:
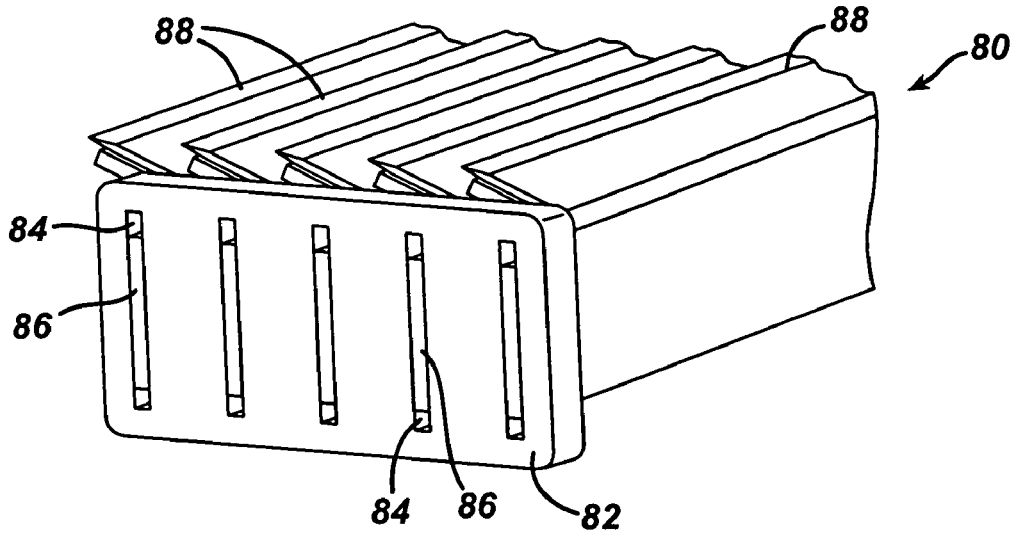
FIGS. 10 and 11 are partial perspective views of an alternative embodiment of a blade subassembly.
Figure 11:
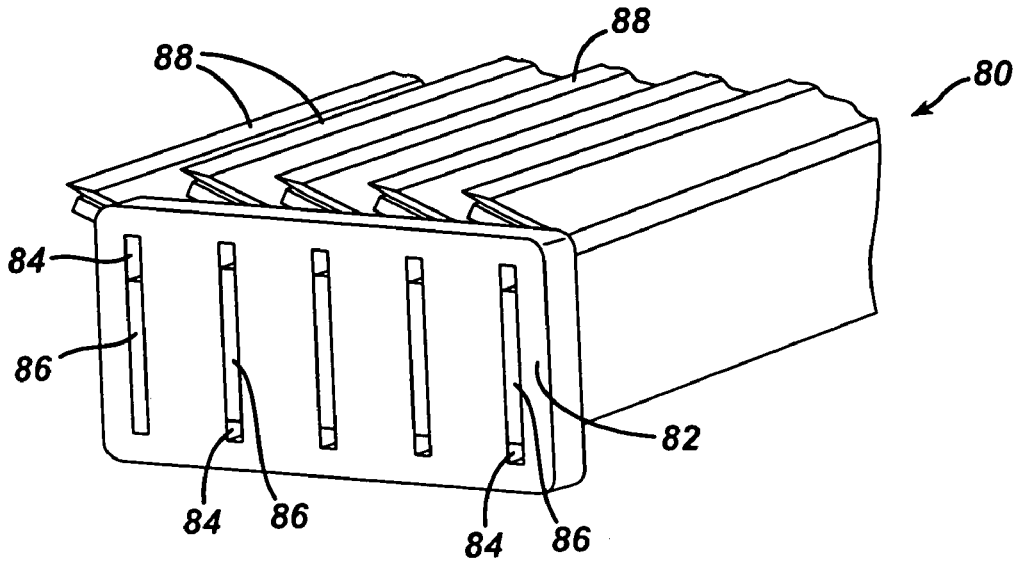
Figure 12:
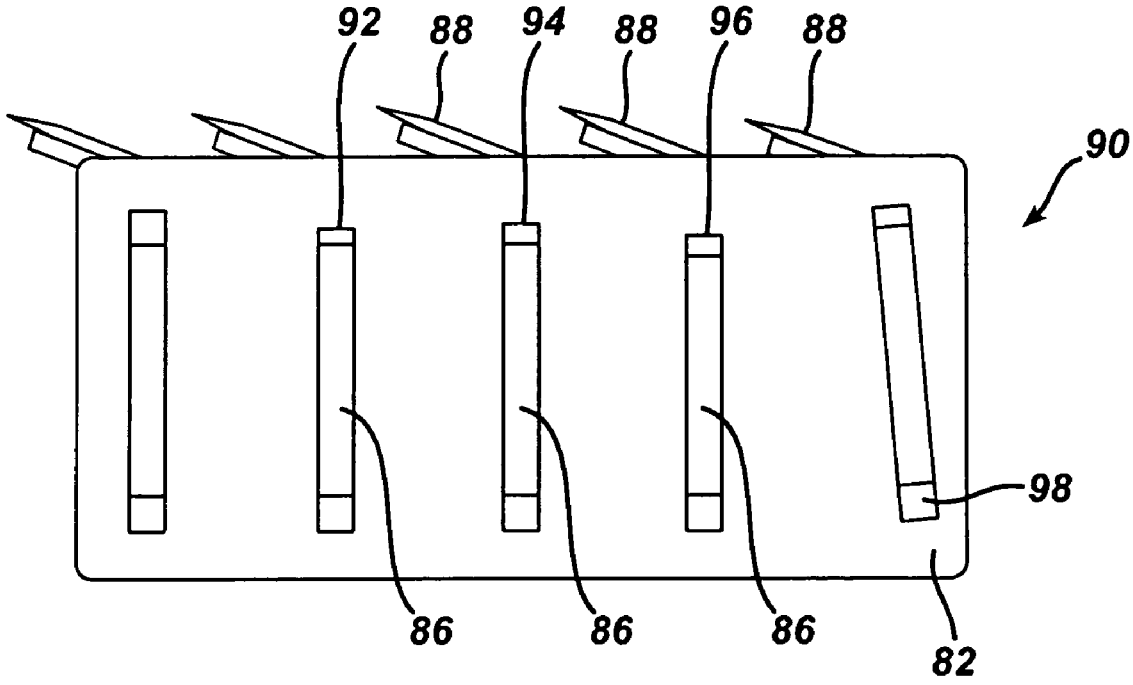
FIG. 12 is an elevation of a further alternative embodiment of a blade subassembly.

Referring to FIGS. 10,11, alternative blade subassembly 80 has end blocks 82 with vertical slots 84 in which longitudinal ends 86 of blades 88 are freely slidable during shaving. Springs to bias blades 88 upward in use can be provided as arms that are integrally molded on the inside of end blocks 82 (similar to arms molded in a cartridge housing shown in U.S. Pat. No. 6,009,624) or formed on the bottoms of the blade supports (as in U.S. Pat. No. 4,932,122) or by other means. In FIG. 10 the blades 88 are shown in an upward position, and in FIG. 11 the blades 88 are shown in a lower position. The top position for the blades 88 can be set by clips 23, as in the embodiment of FIGS. 1-2. In this case all cutting edges will be in a common plane, and the exposures for the three middle blades will be zero with respect the blades 1 and 5. Alternatively the top positions for the blades can be set by slots 84. This will permit nonzero exposures for the middle blades, and will permit exposure to be set simply by changing the end block slots, without the need to provide new tooling for the cartridge. E.g., in FIG. 12, slots 92, 94, 96 of subassembly 90 have different heights to provide nonzero exposure. Also, the slot angles can be nonparallel to provide different travel for different blades, as shown, e.g., for slot 98 in FIG. 12. One could thus provide a variety of different blade geometries in a common razor design with common components, by simply providing a variety of different end blocks with different slot configurations.

Other embodiments of the invention are within the scope of the appended claims.

Figure 15:
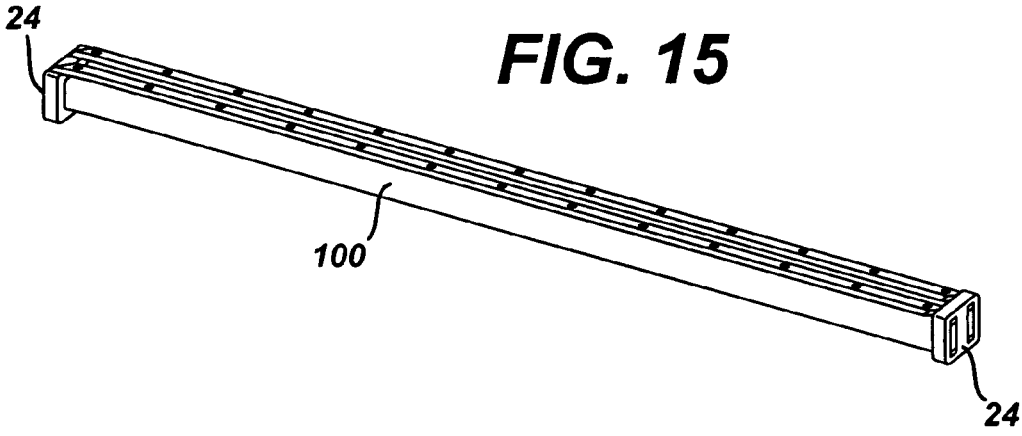
FIGS. 15-17 are a perspective view of two-, three- and four-blade alternative subassemblies, respectively, for use in the FIG. 1 shaving razor.
Figure 16:
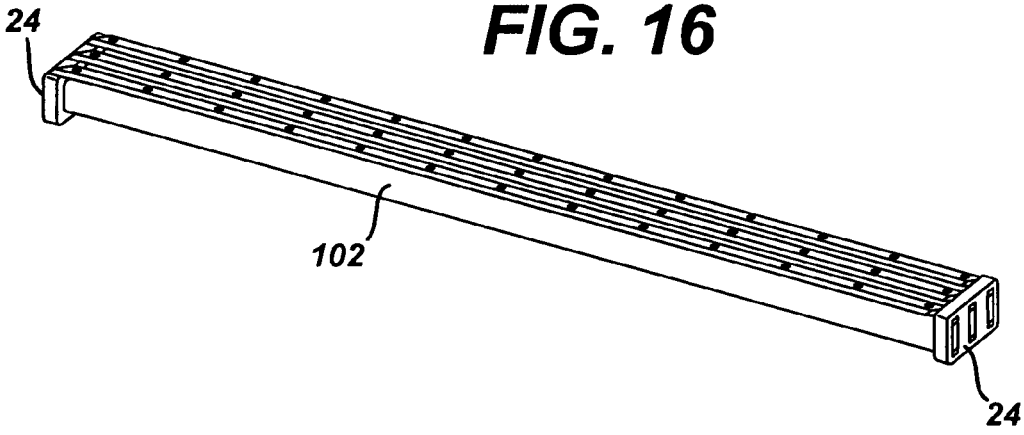
Figure 17:
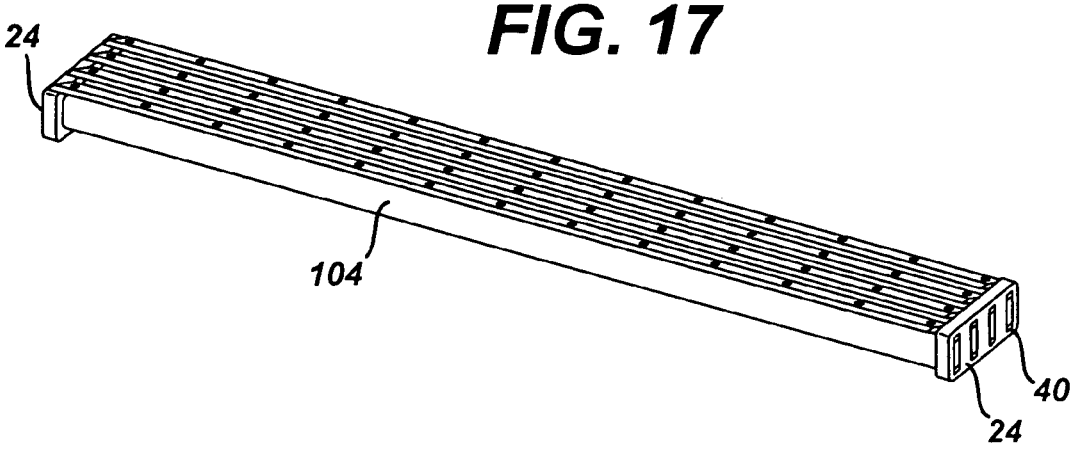

There can be any number of blades, (e.g., 2, 3, 4, 5, 6, 7, etc). Two-, three- and four-blade subassemblies 100, 102, 104, respectively, are shown in FIGS. 15-17, respectively. Also, the cartridge and handle may be integral parts such as a disposable razor.

LISTING OF REFERENCE NUMERALS shaving razor 10
housing 12
integrated blade subassembly 13
blades 14
cap 16
handle 18
connecting piece 19
elastomeric guard 20
recess 21
fins 22
clips 23
elastomeric rail 25
cutting member 26
cutting edges 28
elongated support 30
spot welds 32
short upper portion 34
longer base portion 36
longitudinal ends 38
one-piece complex member 39
slots 40
one-piece simple cutting member 41
hole 42
projection 44
blade subassembly 80
end blocks 82
vertical slots 84
longitudinal ends 86
blades 88
subassembly 90
slot 92
slot 94
slot 96
slot 98
two-blade subassembly 100
three-blade subassembly 102
four-blade subassembly 104

What is claimed is:

1. A method of making a shaving razor, the method comprising the steps, in the order of:

providing a housing including a generally rectangular recess having four side walls and carrying a guard member, providing a plurality of elongated metal razor blades, each blade having a cutting edge and first and second longitudinal ends, providing a first plastic block having non-contiguous slots, providing a second plastic block having non-contiguous slots, securing said first longitudinal ends in said non-contiguous slots in said first plastic block and said second longitudinal ends in said non-contiguous slots in said second plastic block such that said cutting edges collectively define a shaving surface, and said blades and blocks provide an integrated blade subassembly, wherein said blades are movable in said non-contiguous slots during shaving, and wherein one of said slots is angled obliquely relative to another one of said slots to set a different blade angle, and one of said slots has a top end lower than a top end of another slot to set a different blade exposure; and inserting said integrated subassembly into the rectangular recess wherein said guard member is in front of said blades.

2. The method of claim 1 wherein said recess is open to the top, and said inserting involves lowering said integrated blade subassembly into said recess.

3. The method of claim 1 further comprising a lubricating strip carried by said housing.

4. The method of claim 1 wherein no part of said integrated blade subassembly extends beyond an outer surface of said first and second blocks.

5. A method of making a shaving razor, the method comprising the steps, in the order of:

providing a housing including a generally rectangular recess having four side walls, providing a plurality of elongated metal razor blades, each blade having a cutting edge and first and second longitudinal ends, providing a first plastic block having non-contiguous slots, providing a second plastic block having non-contiguous slots, securing said first longitudinal ends in said non-contiguous slots in said first plastic block and said second longitudinal ends in said non-contiguous slots in said second plastic block such that said cutting edges collectively define a shaving surface, and said blades and blocks provide an integrated blade subassembly, wherein said blades are movable in said non-contiguous slots during shaving and wherein one of said slots is angled obliquely relative to another one of said slots to set a different blade angle, and one of said slots has a top end lower than a top end of another slot to set a different blade exposure and wherein no part of said integrated blade subassembly extends beyond an outer surface of said first and second blocks, and inserting said integrated subassembly into the rectangular recess.

* * * * *